US005996912A

United States Patent [19]

Ren et al.

[11] Patent Number: 5,996,912

[45] Date of Patent: Dec. 7, 1999

[54] FLAT NEEDLE FOR PRESSURIZED SWIRL FUEL INJECTOR

[75] Inventors: Wei-Min Ren, Yorktown; Jingming Jim Shen, Newport News, both of Va.

[73] Assignee: Siemens Automotive Corporation, Auburn Hills, Mich.

[21] Appl. No.: 08/999,411

[22] Filed: Dec. 23, 1997

[51] Int. Cl.[6] ..... F02M 51/06

[52] U.S. Cl. ..... 239/585.5; 251/129.21; 251/333

[58] Field of Search ..... 239/585.1, 585.3, 239/585.5, 463, 464, 468, 504; 251/129.21, 333

[56] References Cited

U.S. PATENT DOCUMENTS

| | | | |
|---|---|---|---|
| 4,687,142 | 8/1987 | Sasao et al. | 239/585.5 |
| 4,699,323 | 10/1987 | Rush et al. | 239/552 |
| 4,907,745 | 3/1990 | Messingschlager | 239/585.5 |
| 5,044,562 | 9/1991 | Rogers et al. | 239/552 |
| 5,341,994 | 8/1994 | Wakeman | 239/585.5 |
| 5,383,607 | 1/1995 | Heyse et al. . | |
| 5,423,489 | 6/1995 | Wood | 239/585.1 |
| 5,533,480 | 7/1996 | Jenkins . | |
| 5,699,963 | 12/1997 | Ueda | 239/585.1 |
| 5,730,367 | 3/1998 | Pace et al. | 239/585.1 |
| 5,775,600 | 7/1998 | Wildeson et al. | 239/585.1 |

FOREIGN PATENT DOCUMENTS

| | | |
|---|---|---|
| 03 088961 A | 4/1992 | Japan . |
| 10 047210 A | 2/1998 | Japan . |

*Primary Examiner*—Andres Kashnikow
*Assistant Examiner*—Lisa A. Douglas

[57] ABSTRACT

The injector nozzle includes a cylindrical needle which is axially reciprocated by an armature assembly. The needle has a needle tip terminating in a flat end surface with a spherical transition surface between the flat end surface and the side walls of the needle. Depending upon the diameter of the needle and the included angle of the valve seat, the diameter of the flat end surface may be less than the diameter of the orifice through the valve seat. The circular edge defined between the flat end surface and the spherical transition surface defines a location where the liquid fuel and air consistently separate from the needle in the valve-open condition whereby variations in the spray cone angle and the flow rate are minimized during steady-state and transient operating conditions.

10 Claims, 2 Drawing Sheets

FLAT NEEDLE FOR PRESSURIZED SWIRL FUEL INJECTOR

TECHNICAL FIELD

The present invention relates generally to fuel injectors for injecting liquid fuel for combustion in an internal combustion engine and particularly relates to a high pressure swirl fuel injector for directly injecting fuel into a combustion chamber.

BACKGROUND

As is well known, fuel injectors for injecting fuel into internal combustion engines typically include an armature assembly for axially reciprocating a needle within the interior of the fuel injector body in response to electrical energization and deenergization of an electromechanical actuator to selectively open and close a fuel flow passage through the tip of the fuel injector. The needle of the armature assembly typically reciprocates in relation to a valve seat between a valve-open position for flowing fuel through an orifice at the injector tip and a valve-closed position with the tip of the needle engaging the valve seat. Conventionally, the tip of the needle is provided with a spherical configuration for engagement with the valve seat.

Many fuel injectors provide a swirl to the fuel being injected. A swirl-type injector has the advantage of injecting a widely dispersed spray and promoting atomization with relatively low injection pressure. During the injection process, the pressurized fuel is forced to flow through tangential passages and creates a high angular velocity. As a result, the fuel emerges from the discharge orifice in the form of a thin conical sheet which produces a hollow cone spray and rapidly disintegrates into fine droplets. Because of the nature of the surfaces defining the flow passage in the valve-open position, i.e., the spherical tip of the needle and the frustoconical recessed portion of the valve seat, the liquid fuel sheet does not separate consistently from the needle tip at designed locations. That is, there is an interface between the liquid fuel and the air within the valve structure which does not separate from the tip of the needle at a well-defined constant location. This inconsistent separation causes substantial variations in the flow rate and the spray cone angle, i.e., the angle between the sides of the spray cone pattern during steady-state and transient operating conditions. For example, spray cone angle variations have been found to be as high as 5° for spherical needles, while flow rate variations have been found to be approximately ±4.8% with the spherically-shaped needle tip. The consistency of the location of the separation of the liquid sheet from the needle tip is significant in accurately metering the fuel and forming the desired spray cone angle. It is particularly significant in a direct injection spark-ignited engine where fuel is injected directly into the combustion volume because there is only a very short time available for air/fuel mixing. Consequently, there is a demonstrated need to reduce variations in the spray cone angle and flow rate for fuel injectors.

DISCLOSURE OF THE INVENTION

According to the present invention, there is provided a fuel injector fuel specifically configured to reduce variations in the spray cone angle and flow rate during steady-state and transient operating conditions and specifically to provide a needle tip configuration which will force the fuel/air to separate consistently at the same constant location thereal-ong. To accomplish the foregoing, the tip of the needle of the injector is provided with a flat end surface generally normal to the axis of the fuel injector needle and its axis of reciprocation. The diameter of the flat end surface is smaller than the diameter of the underlying orifice of the valve seat. Consequently, there is provided a demarcation line, e.g., a circular edge, between the flat end surface of the needle and a transition surface between the flat end surface and the sides of the needle. This edge is designed to form the separation location of the liquid and air relative to the needle tip. Because the edge is a fixed structure on the needle, the separation of the fuel and air relative to the needle tip is constant and consistent throughout steady state and transient operations.

Preferably, the transition surface between the flat end surface and the sides of the needle is in the form of a spherical surface. Because, in most instances the flat end surface is smaller in diameter than the diameter of the orifice, the engagement between the spherical surface of the needle tip and the tapered conical seat about the orifice forms the seal therebetween in the valve-closed position. With this construction, the variations in the spray cone angle and flow rate are greatly reduced in comparison with the spray cone angle and flow rate employing a spherical needle tip, thus facilitating the formation of a spray cone constantly at the designed angle and a consistent flow rate of the fuel. This achievement is particularly important for direct injection spark-ignited engines where there is only a relatively short time available for air/fuel mixing.

In a preferred embodiment according to the present invention, there is provided a fuel injector for an internal combustion engine, comprising an armature assembly, a seat having an orifice therethrough, the armature assembly including an injector needle reciprocable along an axis between a first position having a tip thereof spaced from the seat defining a passage for flowing fuel between the needle and the seat through the orifice and a second position with the tip engaging the seat and closing the fuel passage, the needle tip having a flat end face normal to the axis.

In a further preferred embodiment according to the present invention, there is provided a fuel injector for an internal combustion engine, comprising an injector body having a seat, an orifice through the seat and an injector needle reciprocable along an axis between a first position having a tip thereof spaced from the seat defining a passage for flowing fuel between the needle and the seat and through the orifice and a second position with the tip engaging the seat and closing the fuel passage, the needle tip having a flat end face normal to the axis and having a lateral dimension less than a lateral dimension of the needle, the end face forming a continuous edge within lateral confines of the needle defining a location for separating the fuel from the needle tip in the first position of the needle relative to the seat.

Accordingly, it is a primary object of the present invention to provide a novel and improved fuel injector having reduced variations in spray cone angle and flow rate and which is particularly effective in direct injection spark-ignited engines.

BEST MODE FOR CARRYING OUT THE INVENTION

Figure 1:
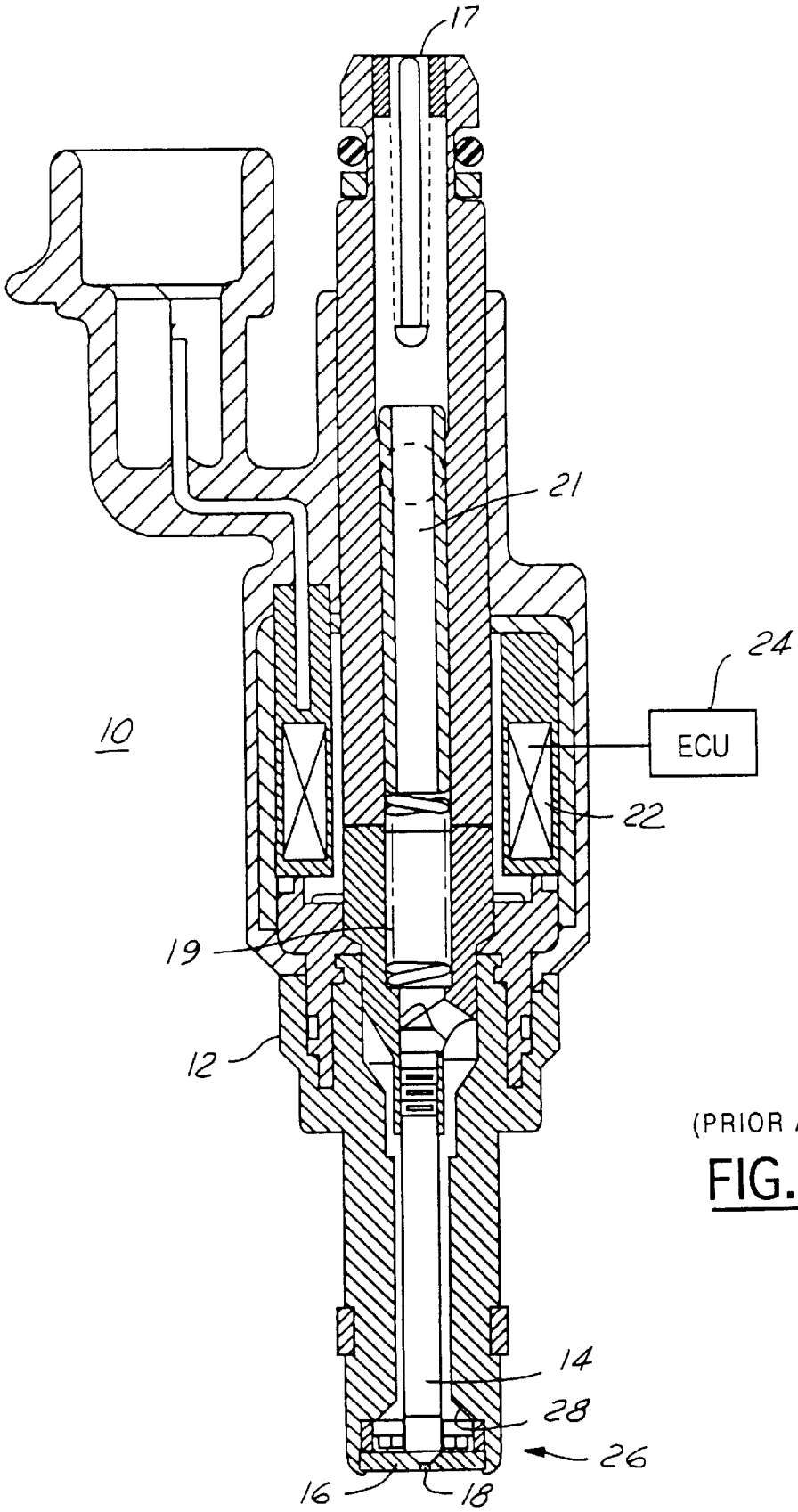
(PRIOR ART) FIG. 1
FIG. 1 is a cross-sectional view of a conventional fuel injector having a spherical surface at the lower end of the injection needle.

Referring now to FIG. 1, there is illustrated a fuel injector, generally designated 10, including a reciprocating armature assembly 12 supporting an injector needle 14. The armature assembly 12 is reciprocable to displace the needle 14 along its axis between open and closed positions relative to the valve seat 16. The injector needle includes a needle tip spaced from a valve or needle seat 16 in the valve-open position to enable fuel flow through a discharge orifice 18 and engaging the valve or needle seat 16 in the valve-closed position adjacent discharge orifice 18. The armature assembly 12 includes a spring 19 which urges the needle 14 toward a closed position. An electromagnetic coil 22, in response to receiving pulsed electrical signals, causes the armature assembly 12 and needle 14 to be periodically displaced against the force of the spring thereby to periodically displace the needle to the valve-open position. A driver circuit 24 of an ECU applies the signals to the electromagnetic coil 22. Fuel is supplied to a fuel injector inlet 17 for flow through a central axial passageway 21, through armature 12, about needle 14 for egress through the discharge orifice 18. The tip of needle 14 is conventionally spherically-shaped.

Figure 2:
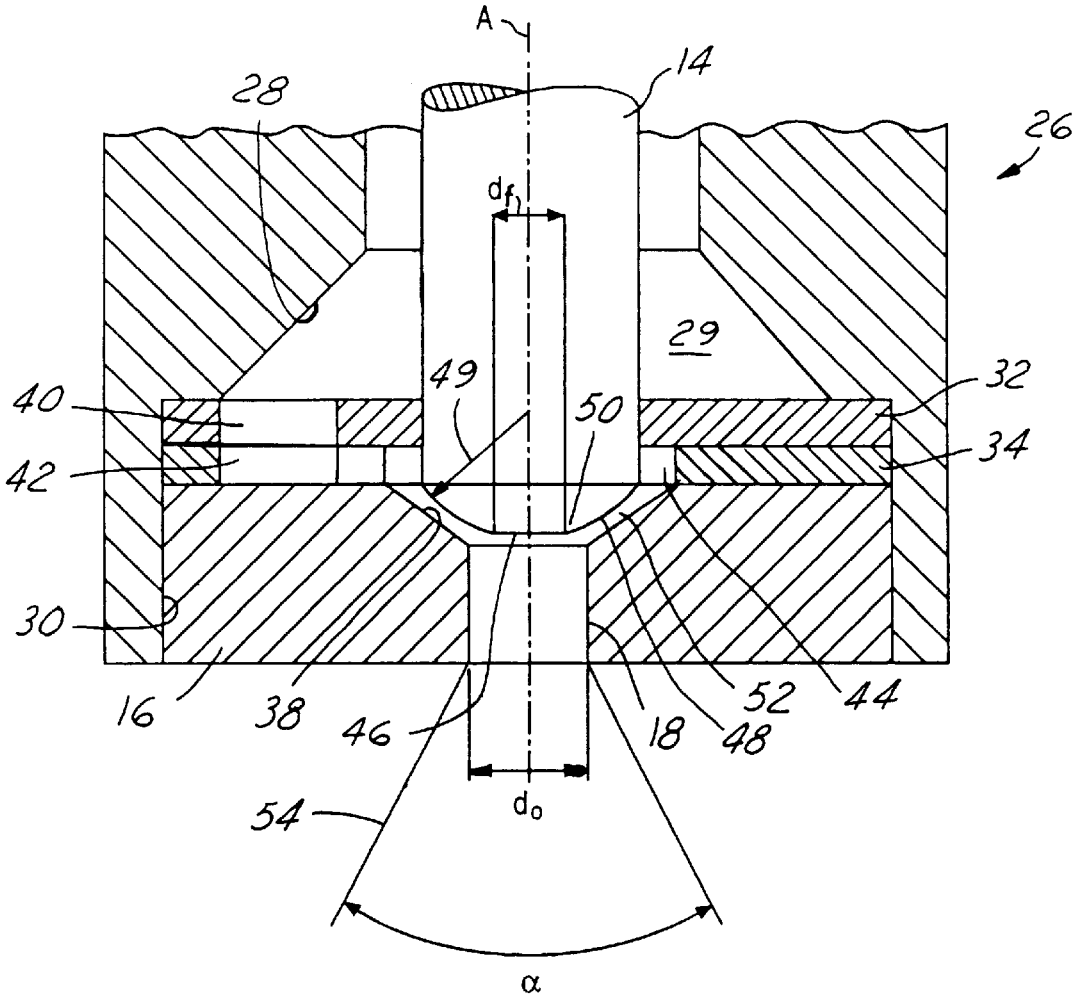
FIG. 2 is a fragmentary enlarged cross-sectional view of an end portion of a fuel injector constructed in accordance with the present invention.

As illustrated in FIG. 2, the lower body 26 of the fuel injector 10 includes a chamber having an outwardly and downwardly tapered wall surface 28 and a cylindrical wall surface 30 which houses a lower guide 32, a metering swirl disk 34 and the valve seat 16. The guide 32 and disk 34 have central openings for slidably receiving the needle 14. The valve seat 16 includes a tapered surface 38, i.e., a frustoconical surface, terminating in the cylindrical central orifice 18. Each of the guide 32 and metering swirl disk 34 have registering openings 40 and 42, respectively, for receiving fuel flowing in the annular space between the needle 14 and the valve body 26 into the chamber 29. The fuel is directed by the metering disk to flow into the volume between the needle tip and the tapered conical surface 38 for flow through orifice 18. The metering swirl disk 34 thus has passages 44 in communication with the volume between the tip of the needle 14 and surface 38. The foregoing elements of the injector are well known and further description thereof is not believed necessary.

In accordance with the present invention as evident from FIG. 2, the tip of the needle 14 has a flat planar circular surface 46 normal to the axis A of needle 14 and a transition surface 48 between the flat circular surface 46 and the cylindrical side walls of the needle 14. Preferably, the transition surface 48 forms part of a spherical surface having a radius 49 with a center at a location along the axis A of needle 14. Consequently, the juncture of the transition surface 48 and the flat circular surface 46 forms a sharp circular edge 50 being defined by a plane normal to the axis A of needle 14 and intersecting the spherical surface. In a majority of the embodiments, depending upon the diameter of the needle and the included angle of the frustoconical valve seat, the diameter $d_f$ of the flat end surface 46 is also less than the diameter $d_o$ of the orifice 18, the orifice and needle lying on axis A.

The needle and valve seat are illustrated in the valve-open position defining a flow passage 52 between the transition surface 48 and the tapered surface 38 for flowing fuel from the metering swirl disk 34 to the orifice 18. The edge 50 forms a circular separation line, i.e., a flow break-off location, where the liquid fuel consistently separates from the needle tip for flow through the orifice. It will be appreciated that the swirling flow through the flow passage 52 and orifice 18 results in a conical spray pattern 54 having a spray cone angle , i.e., between opposite sides of the spray cone. By locating the edge 50 at the juncture of the flat end surface of the tip and the transition surface 48, the variations in the spray cone angle and the flow rate are minimized during steady-state and transient operations. As compared with the conventional spherical end surface of the needle tip, a flow rate variation decreased to ±2.2% compared with ±4.8% with a spherical needle tip. The cone angle variation decreased to 3° from an original 5° with a spherical needle tip.

In a preferred embodiment of the present invention, the needle may have a diameter of about 2 mm, the flat surface may have a diameter of about 0.7 mm, preferably 0.72 mm and the orifice may have a diameter of about 1 mm. The spherical transition surface 48 may have a radius 49 of about 1.2 mm with a center on the axis A.

It will be appreciated that in the closed position of the needle, the transitional spherical surface 48 engages the tapered surface 38 to close the valve. In that respect, the needle operates similarly as the prior needle tips having complete spherical surfaces of their tips. However, when the needle is withdrawn away from the surface 38 into the illustrated valve-open position, the flow will separate from the needle tip at the edge 50 between the flat end surface 46 and the spherical surface 48 to minimize the variations in spray cone angle and flow rate. As indicated previously, this is highly significant in direct injection spark-ignited engines where the fuel injector opens directly into the combustion chamber, i.e., a chamber defined in part by the tip of injector 10.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel injector for an internal combustion engine, comprising:

an armature assembly;

a seat having an orifice therethrough;

said armature assembly including an injector needle reciprocable along an axis between a first position having a tip thereof spaced from said seat defining a passage for flowing fuel between said needle and said seat through said orifice and a second position with said tip engaging said seat and closing said fuel passage;

said needle tip having a flat end face normal to said axis;

said needle being generally cylindrical and said flat end face being circular, said flat end face having a diameter less than the diameter of said needle, said tip having a transition surface joining said flat end face and sides of said needle, said transition surface including a portion of a spherical surface forming a sharp circular edge with said flat end face at a location between said orifice and said armature in said first position of said needle, said edge being defined by a plane normal to said axis and intersecting the spherical surface, said circular edge enabling fuel separation from said needle in said first position thereof.

2. A fuel injector according to claim 1, wherein said valve seat includes a recessed frustoconical tapered surface engaged by said spherical surface in said second position of said needle.

3. A fuel injector according to claim 2 including a swirl disk surrounding said needle upstream of said passage and overlying said seat for imparting a swirl to the fuel flowing through the passage and orifice and forming a conical spray pattern of fuel discharging from said orifices, said circular edge minimizing variations in spray cone angle and flow rate of the fuel past said needle.

4. A fuel injector according to claim 1 wherein said needle has a diameter of about 2 mm, said flat surface has a diameter of about 0.7 mm and said orifice has a diameter of about 1 mm.

5. A fuel injector according to claim 4 wherein the spherical surface has a radius of about 1.2 mm.

6. A fuel injector for an internal combustion engine, comprising:

an injector body having a seat, an orifice through said seat and an injector needle reciprocable along an axis between a first position having a tip thereof spaced from said seat defining a passage for flowing fuel between said needle and said seat and through said orifice and a second position with said tip engaging said seat and closing said fuel passage;

said needle being generally cylindrical and terminating in a needle tip having a flat end face normal to said axis, said flat end face having a diameter less than a diameter of said needle, said tip having a transition surface including a portion of a spherical surface forming a continuous circular edge with said flat end face at a location between said orifice and said armature in said first position of said needle, said edge being defined by the intersection of a plane normal to said axis and the spherical surface and defining a location for separating the fuel from the needle tip in the first position of the needle relative to the seat.

7. A fuel injector according to claim 6 wherein said valve seat includes a recessed frustoconical tapered surface engaged by said spherical surface in said second position of said needle.

8. A fuel injector according to claim 7 including a swirl disk surrounding said needle and overlying said seat for imparting a swirl to the fuel flowing through the passage and orifice.

9. A fuel injector according to claim 8 wherein said needle has a diameter of about 2 mm, said flat surface has a diameter of about 0.7 mm and said orifice has a diameter of about 1 mm.

10. A fuel injector according to claim 9 wherein the spherical surface has a radius of about 1.2 mm.

* * * * *